US010125520B2

(12) United States Patent
Wild et al.

(10) Patent No.: US 10,125,520 B2
(45) Date of Patent: Nov. 13, 2018

(54) KEY AND ROTARY CYLINDER LOCK WITH KEY

(71) Applicant: ASSA ABLOY (Schweiz) AG, Richterswil (CH)

(72) Inventors: Thomas Wild, Richterswil (CH); Detlef Sprenger, Siebnen (CH)

(73) Assignee: ASSA ABLOY (SCHWEIZ) AG, Richterswil (CH)

( * ) Notice: Subject to any disclaimer, the term of this patent is extended or adjusted under 35 U.S.C. 154(b) by 57 days.

(21) Appl. No.: 14/904,194

(22) PCT Filed: Jul. 9, 2014

(86) PCT No.: PCT/EP2014/064726
§ 371 (c)(1),
(2) Date: Jan. 11, 2016

(87) PCT Pub. No.: WO2015/004192
PCT Pub. Date: Jan. 15, 2015

(65) Prior Publication Data

US 2016/0160528 A1 Jun. 9, 2016

(30) Foreign Application Priority Data

Jul. 10, 2013 (EP) ..... 13175907

(51) Int. Cl.
*E05B 27/00* (2006.01)
*E05B 35/00* (2006.01)
*E05B 19/00* (2006.01)

(52) U.S. Cl.
CPC ..... *E05B 27/0021* (2013.01); *E05B 19/0082* (2013.01); *E05B 27/001* (2013.01);
(Continued)

(58) Field of Classification Search
CPC ..... E05B 19/06; E05B 19/12; E05B 27/02; E05B 27/0021; E05B 19/0082;
(Continued)

(56) References Cited

U.S. PATENT DOCUMENTS 3,688,269 A 8/1972 Miller
D250,990 S 2/1979 Hanneman et al.
(Continued)

FOREIGN PATENT DOCUMENTS

CN 1078529 A 11/1993
CN 1268989 A 10/2000
(Continued)

OTHER PUBLICATIONS

Chinese Office Action, dated Dec. 22, 2016. In corresponding application No. 201480038999.7 (particularly pp. 10-12, which list the cited references and categorize them in accordance with established PCT prior art pategories "X", "Y" and "A").

*Primary Examiner* — Suzanne L Barrett
(74) *Attorney, Agent, or Firm* — Browdy and Neimark, P.L.L.C.

(57) ABSTRACT

A key (1) for a rotary cylinder lock (2) comprises a key grip (3) and a key shank (4), which adjoins the key grip (3) and extends along a longitudinal axis (L), wherein the key shank (4) has, on its outside (5), control recesses (10), in particular control bores, for properly positioning tumblers on the rotary cylinder lock (2) and also has at least one control element (6) arranged in a movable manner in the key shank (4), which control element (6) has a control surface (8), which interacts with a tumbler (7) of the rotary cylinder lock (2). Furthermore, the key is characterized in that the key shank (4), in the region of the control element (6), has a tapered cross section (9), which is tapered in relation to the cross section (11) with the control recesses (10).

38 Claims, 8 Drawing Sheets

(52) U.S. Cl.
CPC ..... *E05B 27/0014* (2013.01); *E05B 27/0046* (2013.01); *E05B 35/003* (2013.01)

(58) Field of Classification Search
CPC ..... E05B 27/001; E05B 27/0014; E05B 27/0046; E05B 35/003
USPC ..... 70/490–493, 367, 409, 398
See application file for complete search history.

(56) References Cited

U.S. PATENT DOCUMENTS

| | | | | |
|---|---|---|---|---|
| 4,667,495 | A * | 5/1987 | Girard | E05B 19/0017 70/358 |
| 5,383,345 | A | 1/1995 | Kallinger-Prskawetz-Jacobsen | |
| D361,708 | S | 8/1995 | Kahonen | |
| 5,437,176 | A | 8/1995 | Keller | |
| D389,624 | S | 1/1998 | Drimmie et al. | |
| 5,718,136 | A * | 2/1998 | Aldieri | E05B 27/005 70/337 |
| D495,584 | S | 9/2004 | Su | |
| D635,006 | S | 3/2011 | Heikinmatti | |
| D678,038 | S | 3/2013 | Schindler et al. | |
| D680,417 | S | 4/2013 | Crepinsek | |
| 8,746,025 | B2 * | 6/2014 | Haviv | E05B 35/003 70/395 |
| D759,462 | S | 6/2016 | Bransgrove | |
| D765,490 | S | 9/2016 | Nicoara | |
| D788,931 | S | 6/2017 | Jones Andersson et al. | |
| 2011/0048084 | A1 | 3/2011 | Tong | |

FOREIGN PATENT DOCUMENTS

| | | | |
|---|---|---|---|
| EP | 0605932 | A2 | 7/1994 |
| EP | 0621384 | A1 | 10/1994 |
| EP | 2218850 | A1 | 8/2010 |
| FR | 2561293 | A1 | 9/1985 |
| FR | 2619149 | A1 | 2/1989 |
| FR | 2776327 | A1 | 9/1999 |

* cited by examiner

KEY AND ROTARY CYLINDER LOCK WITH KEY

TECHNICAL FIELD

The present invention relates to a key according to the preamble of claim 1 and to a rotary cylinder lock with the key according to the preamble of claim 11.

PRIOR ART

EP 0 621 384 has disclosed a key with a matching rotary cylinder lock. A control element which cooperates with an additional tumbler of the rotor is arranged in the shank of the key.

Although the keys and rotary cylinder locks according to EP 0 621 384 are considered to be particularly secure against manipulation, there is a great need to increase the security against copying of a key and rotary cylinder lock of this type even further by further increasing the interrogation security.

SUMMARY OF THE INVENTION

Starting from this prior art, the invention is based on an object of providing a key and a rotary cylinder lock which is even more secure with respect to manipulation attempts. Furthermore, the intention is preferably to further increase the security against copying of a key of this type, and the intention is also to increase the number of locking permutations.

Such an object is achieved by the key according to the subject matter of claim 1. According thereto, a key for a rotary cylinder lock comprises a key grip and a key shank which adjoins the key grip and extends along a longitudinal axis. The key shank comprises, on the outer side thereof, control recesses, in particular control bores, for positioning tumblers on the rotary cylinder lock, and at least one control element arranged movably in the key shank. The control element has a control surface cooperating with a tumbler of the rotary cylinder lock. Furthermore, the control shank, in the region of the control element, has a tapered cross section which is tapered in relation to the cross section of the control recesses.

This tapering in the region of the control element makes it possible for the tumbler which cooperates with the control element to be formed with a greater freedom of design, as a result of which space for additional interrogation elements is created in the rotary cylinder lock, in particular in the key channel. With the tapering, it is thus possible to interrogate further elements in the rotary cylinder lock, in particular in the key channel.

The control element preferably protrudes out of the key shank such that the control surface lies at a distance from the outer side of the tapered cross section. The protrusion of the control surface affords the advantage that the contacting with the further tumbler enforces a second, preferably movable, interrogation.

Particularly preferably, in the starting position, the control surface lies in a plane which is defined by the outer side of the key shank in the region of the control recesses. Alternatively, the control surface lies in a region between the outer side of the tapered cross section and said plane.

Alternatively, the control surface lies flush with the outer side of the tapered cross section, as a result of which the compactness of the key is improved.

Said control element preferably comprises a bolt arranged in a bore in the key and a spring element, in particular a compression spring, which spring element subjects the bolt to a force which presses the control element outward, as seen from the key shank. The bolt has said control surface. By means of the spring force outward, it is possible for a tumbler which cooperates with the control element to be positioned outward.

Particularly preferably, the control element has two bolts which extend along a common axis and are acted upon by the same spring element, wherein the first bolt protrudes over a first surface on the key shank or is flush with said surface, and the second bolt protrudes over a second surface on the key shank or is flush with said surface. The two surfaces lie opposite each other with respect to the longitudinal axis and in particular provide the narrow side of the key.

In an alternative embodiment, the control element has only one bolt which is arranged on one side of the key.

The key can therefore have the form of a turning key or a non-turning key, wherein the control element is equally usable.

The bolt preferably has a cylindrical, in particular circular, cross section. The bolt can thereby be guided optimally in the bore in the key.

The bore can be designed as a stacked bore or blind bore or through bore. The bolt can be held by a sleeve which is pressed into the bore and has a passage opening through which the bolt extends.

The bolt is preferably provided with a control edge in the region of the control surface, which control edge extends at an angle to the longitudinal axis. The control edge is preferably a bevel encircling the bolt.

In a preferred embodiment, the tapered region forms the end region of the key shank in the region of the key tip opposite the key grip. In other words, the key shank is designed with the tapered region in the region of the key tip. Consequently, the control element is preferably also arranged in the region of the key tip.

In another preferred embodiment, the tapered region is arranged between key tip and key shank at a distance from the key tip. In this embodiment, the key shank has an elevation between the key tip and the tapered region. This elevation is advantageous because an additional interrogation element can be created, as is explained further below. The elevation preferably has the same cross section as the key shank and is a part of the key shank.

In a further embodiment, there are at least two tapered regions, wherein one of the tapered regions is in the region of the key tip and another tapered region is spaced apart from the key tip, or wherein the at least two tapered regions are spaced apart from the key tip.

Particularly preferably, the elevation extends transversely with respect to the longitudinal direction of the key shank at maximum to the maximum extension of the key shank. The extension of the elevation can be variable such that the latter can be interrogated.

Particularly preferably, the key shank has a first slope and a second slope, wherein the first slope rises to the elevation, and wherein the second slope runs toward the tapered region. Depending on the position of the tapering, the first slope is part of the key tip.

There is preferably precisely one single control element, in particular per tapering. Alternatively, there can also be a plurality of control elements which lie offset with respect to one another along the key shank.

The key serves for actuating a rotary cylinder lock as claimed in claim 11. According thereto, a rotary cylinder lock comprises a stator, a rotor mounted rotatably in the stator, with a key channel, and at least one tumbler cooperating with the control element. The tumbler comprises a stator pin mounted in the stator and a rotor pin mounted in the rotor, wherein rotor pin and stator pin are positionable from a blocking position into a release position by the control element.

In the blocking position, the rotor pin preferably partially projects into the key channel. This partial projection of the rotor pin gives rise in particular to an advantage that the rotor pin can cooperate with the tapered region when the key is pushed in. A first interrogation would be conceivable.

Rotor pin and stator pin are preferably movable radially outward from the blocking position into the release position. The tumbler which cooperates with the control element is therefore positioned outward, as seen from the key channel. From the release position, rotor pin and stator pin are movable radially inward. In the blocking position, the stator pin preferably projects from the stator into the rotor and is then displaced into the stator during the movement from the blocking position into the release position. The movement radially outward takes place in particular in a radial plane which runs centrally through the key channel or through the axis of rotation of the rotor.

The stator pin in the stator is preferably subjected to a spring force by a stator spring, wherein the spring force presses the stator pin and the rotor pin in the direction of the key channel. By means of the stator spring, the tumbler, which is positioned by the control element, is always kept in the blocking position unless the authorized key is inserted into the key channel.

Stator pin and rotor pin are mounted in a corresponding stator bore and rotor bore.

Particularly preferably, the spring force of the spring element of the control element mounted in the key is greater than the spring force of the stator spring, such that the control element moves the stator pin and the rotor pin radially outward with respect to the key channel when the control element comes into contact with the rotor pin. The spring element in the key therefore acts counter to the spring element in the rotary cylinder lock.

In a development of the invention, the rotor pin is mounted movably in a guide sleeve which projects into the key channel. The guide sleeve is fixedly connected to the rotor and cooperates with the tapered region. By means of the cooperation between guide sleeve and the tapered region, a further security interrogation can be carried out.

In a development of the invention, in addition to the tumbler, which cooperates and is positioned with the control element, there is a further tumbler which cooperates with the outer side of the tapered region and is movable radially outward from a blocking position into a release position.

The further tumbler preferably comprises a stator sleeve mounted movably in the stator and a rotor sleeve mounted movably in the rotor, and a stator sleeve spring acting on the stator sleeve. The stator sleeve spring subjects the stator sleeve and the rotor sleeve to a spring force in the direction of the key channel. Furthermore, the rotor sleeve projects with an end side into the key channel and is movable or arrangeable over said end side from the blocking position into the release position by the outer side of the tapered region.

Alternatively or additionally, the tapered region can also cooperate with a tumbler comprising a rotor pin, a stator pin and a stator spring.

The stator sleeve and the rotor sleeve, and also the stator pin and rotor pin, are mounted movably in the stator and rotor, respectively. The stator sleeve and the rotor sleeve are movable radially outward from a blocking position into a release position. In another embodiment, the stator sleeve and the rotor sleeve are movable radially outward from a blocking position over the release position and subsequently radially inward into the release position. Stator sleeve and rotor sleeve, and also stator pin and rotor pin, are mounted in a corresponding stator bore and rotor bore.

In a particularly preferred embodiment, the stator pin and the rotor pin are mounted movably in the stator sleeve and the rotor sleeve, respectively, and are movable radially outward from a blocking position into a release position. A particularly compact structure can be achieved with this embodiment.

If the key has said elevation or the tapered region arranged at a distance from the key tip, the key can cooperate with the tumbler and/or with the further tumbler. The elevation preferably cooperates with the stator pin and the rotor pin of the tumbler and/or with the stator sleeve and rotor sleeve of the further tumbler. When the key is pushed into the key channel, the pair of pins and/or the pair of sleeves is movable radially outward via the elevation from a blocking position over the release position and is then movable from the latter back again into the release position. A combined positioning movement radially outward and then radially inward is therefore substantially involved.

Particularly preferably, the depth of the stator bore in which stator pin and stator sleeve are mounted is greater than the length of the stator pin or stator sleeve. By means of the selection of suitable ratios between the depth of the stator bore and the length of stator pin and stator sleeve and the extension of the elevation on the key shank, a further interrogation can be provided. If, for example, the elevation is too high, the stator sleeve abuts on the outer sleeve of the stator and the key cannot be pushed in. This variation gives rise to a multiplication of permutations.

Further embodiments are specified in the dependent claims.

BRIEF DESCRIPTION OF THE DRAWINGS

Preferred embodiments of the invention are described below with reference to the drawings which serve merely for explanation and should not be interpreted as limiting. In the drawings.

DESCRIPTION OF PREFERRED EMBODIMENTS

Figure 1:
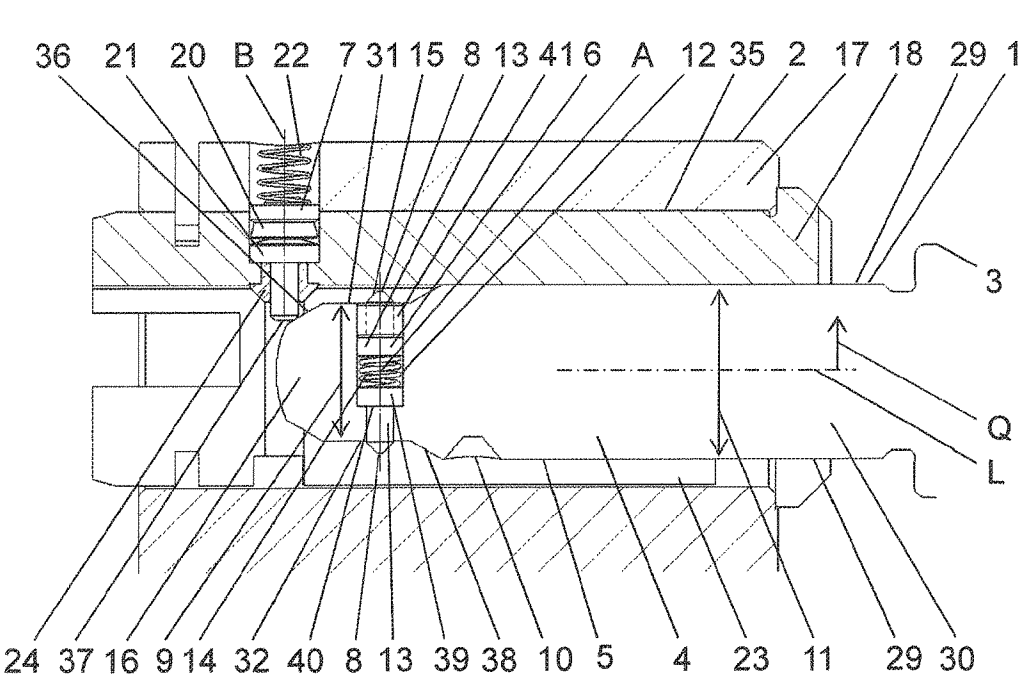
FIG. 1 shows a sectional illustration through a rotary cylinder lock according to a first embodiment and a key according to a first embodiment along the longitudinal axis.

In FIG. 1, a sectional view through a rotary cylinder lock 2 with a key 1 according to a preferred embodiment is shown. The key 1 is partially inserted here into a key channel 23 of the rotary cylinder lock 2.

The key 1 comprises a key grip 3 and a key shank 4 which adjoins the key grip 3 and extends along a longitudinal axis L or longitudinal direction. The user can grasp the key 1 by way of the key grip 3, which is only shown in rudimentary form here, and can thus exert a rotational movement on the key 1. The key shank 4 serves for positioning various tumblers of the rotary cylinder lock 2.

On the outer side 5 thereof, the key shank 4 comprises control recesses 10 which serve for positioning the tumblers on the rotary cylinder lock 2. Conventional control bores which cooperate with conventional tumblers may be involved here.

The outer side 5 is formed by two narrow surfaces 29 lying substantially parallel to each other and by two wide surfaces 30 connecting the narrow surfaces 29.

Furthermore, the key shank 4 comprises at least one control element 6 arranged movably in the key shank 4. The control element 6 cooperates with a tumbler 7 of the rotary cylinder lock 2. The cooperation takes place via a control surface 8 which is arranged on the control element 6 or is part of the control element 6. By means of said control surface 8, the control element 6 comes into contact with the tumbler 7 and positions the latter in relation to the rotary cylinder lock as per the description below.

The key shank 4 is designed with a tapered cross section 9 in the region of the control element 6. The tapered cross section 9 is designed here to be tapered in relation to the cross section 11 with the control recesses 10. The expression "tapered" is understood as meaning a reduced cross section, i.e. a cross section with a smaller cross-sectional area. The key shank here has a smaller height in the tapered cross section 9 than in the cross section 11. The control element 6 is accordingly arranged in the region of the tapered cross section 9.

In the present embodiment, the tapered cross section 9 is designed in such a manner that said cross section tapers the key shank 4 equally on both sides with respect to the longitudinal axis L. The distance in the transverse direction Q to the longitudinal axis L as far as the narrow surface 29 of the key shank is substantially constant here on both sides of the key shank 4 over the entire length of the key shank 4. The outer shape of the key 1, in particular of the key shank 4, is preferably formed symmetrically with respect to the longitudinal axis L.

The transition between the tapered cross section 9 and the cross section with the control recesses 10 is preferably provided via a surface 38 running in an inclined manner with respect to the longitudinal axis L.

The height of the key shank 4 between the two narrow surfaces 29 can be varied over the length of the key shank 4 by the tapered cross section 9.

The width of the key shank 4 between the two wide surfaces 30 is preferably constant over the entire length of the key shank 4.

The control element 6 protrudes out of the key shank 4 such that the control surface 8 lies at a distance from the outer side 5 of the tapered cross section 9. The control surface 8 lies here at a distance from the narrow surface 29. Particularly preferably, in a starting position, the control surface 8 lies in a plane which is defined by the outer side 5 of the key shank 4 in the region of the control recesses 10. The control surface 8 therefore particularly preferably lies flush with the outer side 5 of the key shank 4 outside the tapered region 9. However, the control surface 9 can also lie in a region between the outer side 5 of the tapered cross section 9 and said plane.

In an alternative embodiment, the control surface 8 lies flush with the outer surface 5 or with the surface 29 of the tapered cross section 9.

The control element 6 here is a bolt 13 which is arranged in a bore 12 in the key 1, with a spring element 14 which subjects the bolt 13 to a force such that the bolt 13 is pressed outward, as seen from the key shank 4. If the bolt 13 is pressed into the key shank 4, the spring force of the spring element 14 acts counter thereto. The bolt 13 is therefore pressed outward from the interior of the key shank 4 transversely with respect to the longitudinal axis L or in the transverse direction Q. The force is provided here by the spring element 14, which here has the form of a compression spring.

The control element 6 particularly preferably has two bolts 13 which extend along a common axis A and are movable along said axis A. The two bolts 13 here are acted upon by the same spring element 14. The spring element 14 therefore ensures that the two bolts 13 are pressed outward in the transverse direction Q, as seen from the key shank 4. The first bolt 13 protrudes here over a first surface 31 on the key shank, and the second bolt protrudes over a second surface 32 on the key shank 4. Said surfaces are part of the tapered region 9 and lie opposite each other with respect to the longitudinal axis L. The surfaces 31, 32 in particular provide the narrow surface 29 the narrow side of the key 1.

The bolt 13 preferably has a cylindrical, in particular circular, cross section. The cross section should be understood here as being perpendicular to the axis A.

The bolt 13 has said control surface 8 on the end side. Particularly preferably, the bolt 13 has a control edge 15, which runs at an angle to the longitudinal axis L, in the region of the control surface 8. The control edge 15, which is therefore formed at an inclination to the longitudinal axis L, has the advantage here that the introduction of the key 1 into the key channel 23 and the cooperation with the control elements projecting into the key channel 23 are improved. In addition, the bolt 13 can be actuated via the control edge 15, in particular by elements which project into the key channel 23.

The bolt 13 has a flange 39 here opposite the end side. With the flange 39, the bolt is abuts on a step 40 of a stepped bore or to a sleeve 41 which is pressed into the bore in the key.

The tapered region 9 is arranged here in the region of the key tip 16 in the end region of the key shank 4. The tapered region 9 therefore substantially forms the key tip 16 opposite the key grip 3. The key shank 4 therefore ends with the key tip 16. In an alternative embodiment, it would also be conceivable to arrange the tapered region at other locations on the key shank 4.

The rotary cylinder lock 2 and the cooperation with the above-described key 1 will now be explained more precisely below. FIGS. 1 to 6 show a first embodiment of the rotary cylinder lock and FIGS. 7 to 12 show a second embodiment of the rotary cylinder lock. The two embodiments can be actuated with the above-described preferred key 1.

The rotary cylinder lock 2 comprises a stator 17, a rotor 18, mounted rotatably in the stator 17, with a key channel 23, and at least one tumbler 7 cooperating with the control element 6 arranged in the key 1. The rotor 18 acts in a known manner on a locking bolt of a door.

Furthermore, the rotary cylinder lock 2 preferably comprises at least one tumbler which cooperates with the control recesses 10 and, for the sake of clarity, is not shown here. Said tumblers are positioned by means of the at least one control recess 10.

The tumbler 7 which cooperates with the control element 6 in the key shank 4 comprises a stator pin 20 mounted in the stator 17 and a rotor pin 21 mounted in the rotor 18. The stator pin 20 and the rotor pin 21 move along a common axis B when the rotary cylinder lock 2 is in the blocking position. The stator pin 20 is mounted in a stator bore 33 and the rotor pin 21 is mounted in a rotor bore 34. The pins 20, 21 here are mounted movably in the corresponding bore 33, 34.

Figure 5:
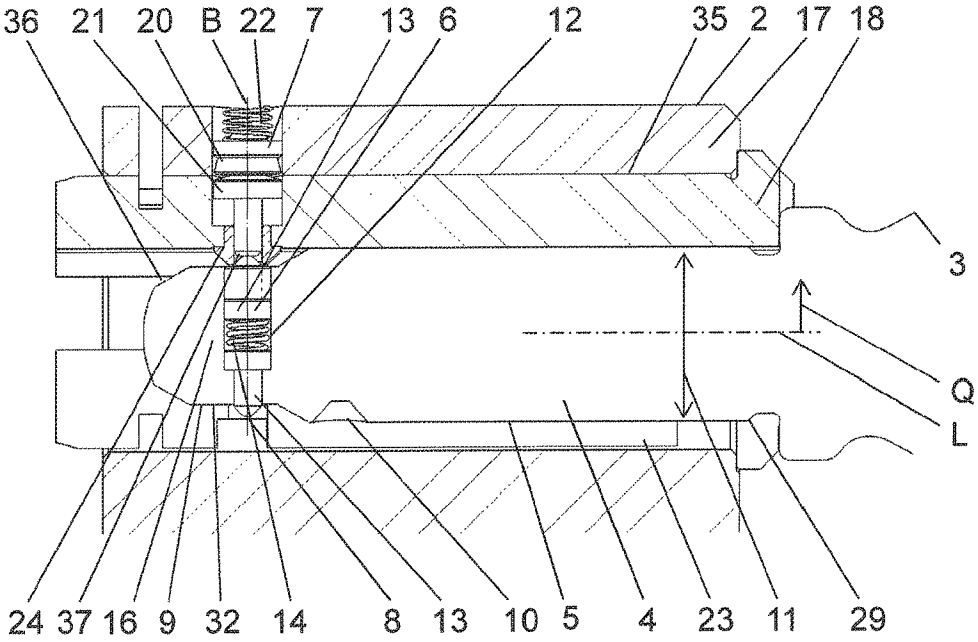
FIG. 5 shows the sectional illustration according to FIG. 1 with the key in the pushed-in position.
Figure 8:
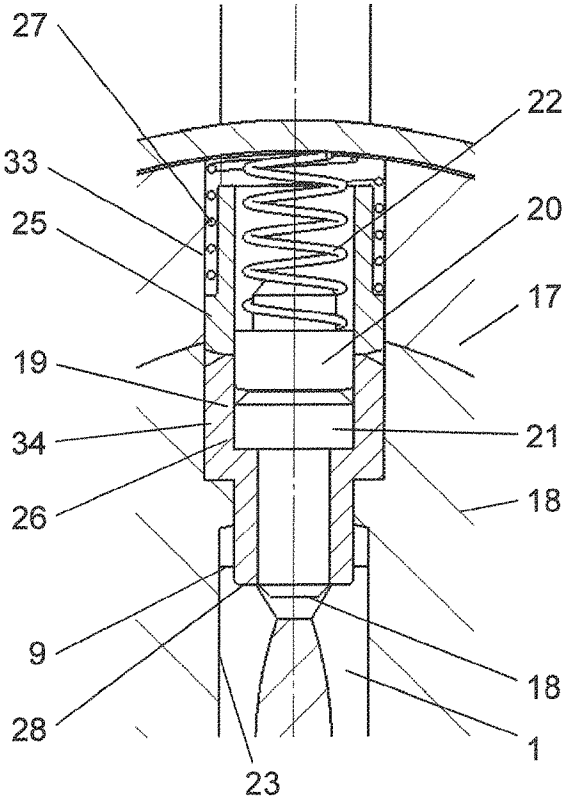
FIG. 8 shows a sectional illustration of the embodiments according to FIG. 7 at a right angle to the longitudinal axis.
Figure 7:
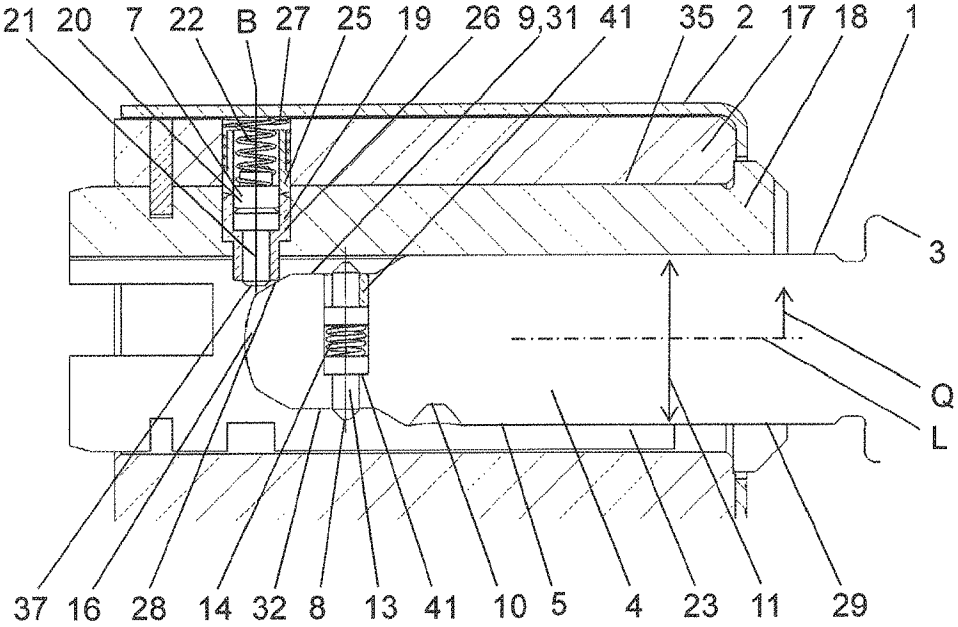
FIG. 7 shows a sectional illustration through a rotary cylinder lock according to a second embodiment and a key according to the first embodiment along the longitudinal axis.

Rotor pin 21 and stator pin 20 are positionable from a blocking position, as shown in FIG. 1, into a release position, as shown in FIG. 5, by means of the control element 6. In the blocking position, the rotor pin 21 partially projects into the key channel 23, and the stator pin 20 partially projects into the rotor bore 34, as a result of which the relative movement between stator 17 and rotor 18 is made impossible or is blocked. Consequently, the control element 6 therefore cooperates with that of the tumbler 7 in such a manner that said tumbler is positionable from the blocking position into the release position in the event of an authorized key.

Figure 2:
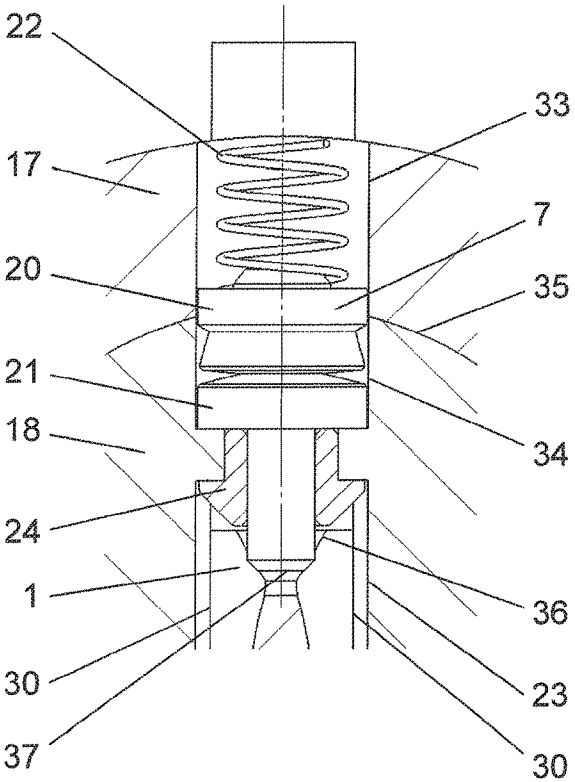
FIG. 2 shows a sectional illustration of the embodiments according to FIG. 1 at a right angle to the longitudinal axis.

FIGS. 1 and 2 show the tumbler 7 in the blocking position. The movement between rotor 18 and stator 17 is blocked here by the stator pin 20 which is located in the region of the shear line 35 between rotor 18 and stator 17. The rotor pin 21 is located completely in the interior of the rotor 18. It can also be seen from FIGS. 1 and 2 that stator pin 20 and rotor pin 21 are pressed inward toward the key channel 23 by a stator spring 22. The package of stator pin 20 and rotor pin 21, that is to say the tumbler 7, is kept in the blocking position by the stator spring 22.

When the key is pushed in, the key shank 4 comes into contact by means of the key tip 16 with that part of the rotor pin 21 which is admitted to the key channel 23. By further pushing of the key in the direction of the stator 17, the rotor pin 21 is pressed outward, i.e. as seen from the key channel 23. For this purpose, the key tip 16 has a chamfer 36 which comes into contact with the rotor pin 21. FIG. 1 shows the position in which the chamfer 36 just comes into contact with the end side 37 of the rotor pin 21. The same situation is shown in FIG. 2 in a section perpendicular to the longitudinal axis L.

Figure 4:
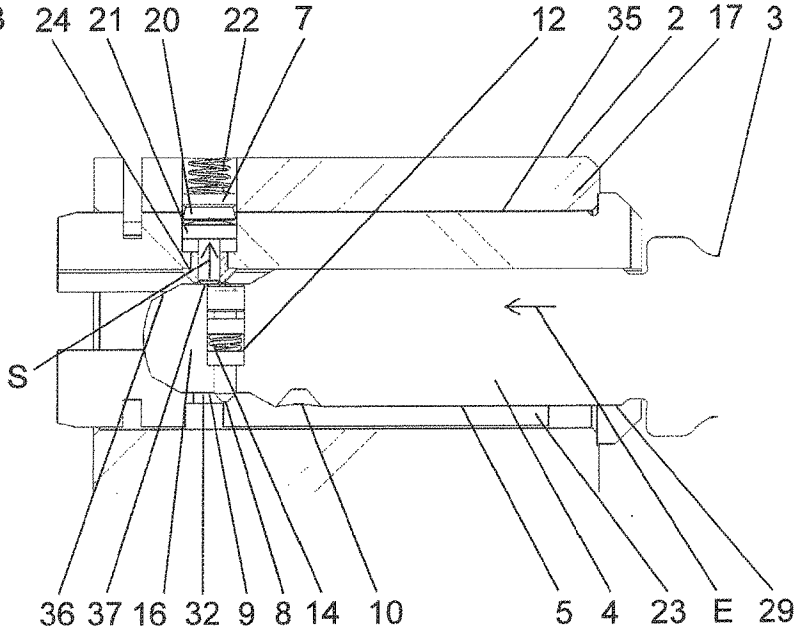
FIG. 4 shows the sectional illustration according to FIG. 1 with the key at a different position.
Figure 3:
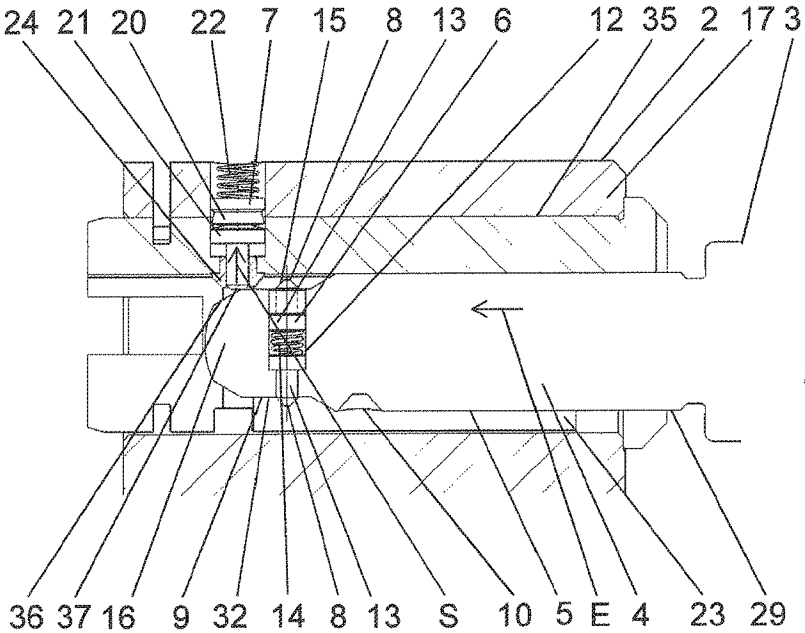
FIG. 3 shows the sectional illustration according to FIG. 1 with the key at a different position.

FIG. 3 shows the further pushing of the key 1 into the key channel 23 of the rotary cylinder lock 2 along the pushing-in direction E. The key 1 here is pushed forward to an extent such that the rotor pin 21 comes to lie in the region of the tapered cross section 9. The rotor pin 21 and therefore also the stator pin 20 are moved outward here counter to the action spring 22. This movement is represented by the radial movement S. On further pushing in, as shown in FIG. 4, the distance between the tumbler 7 and the active region of the control element 6 in the key 1 is reduced.

Figure 6:
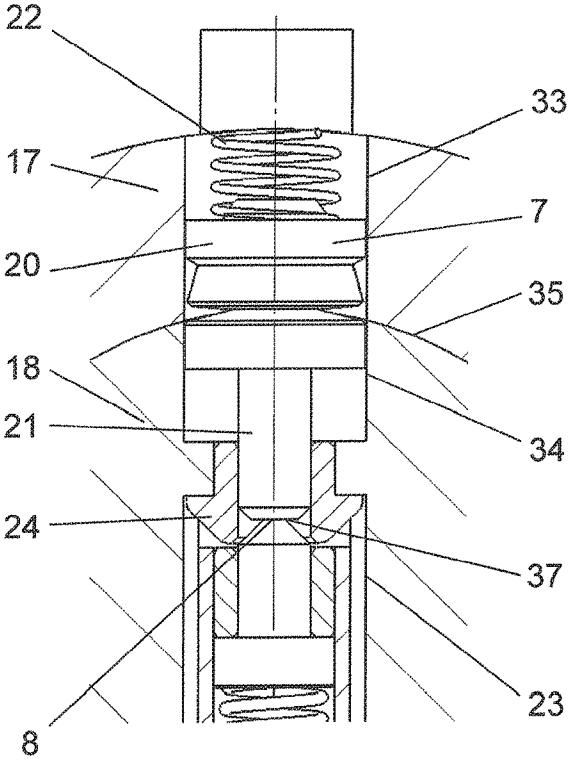
FIG. 6 shows a sectional illustration of FIG. 5 at a right angle to the longitudinal axis.

FIGS. 5 and 6 show the key in the completely introduced position. The axes A of the control element 6 and B of the tumbler 7 lie collinearly to each other here. Owing to the action of the spring element 14 of the control element 6 in the key 1, the rotor pin 21 and therefore also the stator pin 20 are pressed further outward. The control surface 8 of the control element 6 in the key 1 is in contact here with the end side 37 of the rotor pin 21. Owing to the dimensioning of control element 6 and tumbler 7, the rotor pin 21 is moved together with the stator pin 20 by the action of the spring element 14 of the control element 6 to locking height. The contact point between stator pin 20 and rotor pin 21 comes to lie here on the shear line 35. By this means, the rotor 18 can be pivoted with respect to the stator 17.

The spring force of the spring element 14 in the key 1 is greater here than the spring force of the stator spring 22, such that the control element 6 moves the stator pin 20 and the rotor pin 21 radially outward with respect to the key channel 23. Consequently, the tumbler 7, i.e. stator pin 20 and rotor pin 21, are positioned outward, as seen with respect to the key channel 23, by the spring element 14 in the key 1. In other words, it can also be said that the tumbler 7 which cooperates with the control element 6 is positioned radially outward, as seen from the key channel 23. The movement here is provided by the spring element 14 of the control element 6.

In addition, it can be seen in FIGS. 1 to 6 that the rotor pin 21 is mounted movably in a guide sleeve 24. The guide sleeve 24 is optional here. The guide sleeve is mounted, in particular pressed into, the rotor bore 34, and projects into the key channel 23, wherein the cross section of the latter is reduced in the corresponding region. The guide sleeve 24 cooperates here with the tapered region 9. Consequently, the key 1 can only be pushed completely into the key channel when the key 1 has the tapered cross section 9, wherein the tapered cross section 9 cooperates with the guide sleeve 24, which constricts the key channel in the region of the presence of the guide sleeve 24. Particularly preferably, the extent of the projection of the guide sleeve 24 corresponds to the extent of the tapering of the tapered region 31, 32. An additional safety feature can therefore be produced by the guide sleeve 24.

The guide sleeve 24 is fixedly connected to the rotor 18. Particularly preferably, the guide sleeve 24 is pressed into the rotor.

It can furthermore be seen from FIG. 6 that, in a particularly preferred design, the bolt 13 projects into the guide sleeve 24.

Stator pin 20 and rotor pin 21 are preferably of mushroom-shaped configuration.

FIGS. 7 to 12 show a second embodiment of the rotary cylinder lock according to the invention. The rotary cylinder lock according to the second embodiment can be actuated here with the same key 1, as already described above in conjunction with the key 1 as such or in conjunction with the first embodiment. Furthermore, identical parts are provided with the same reference signs.

In addition to the tumbler 7 which cooperates with the control element 6, the second embodiment of the rotary cylinder lock 2 comprises a further tumbler 19 which cooperates with the outer side 31, 32 of the tapered cross section 9. Consequently, the tapered region 9 therefore likewise serves for positioning a corresponding tumbler 19 assigned to the tapered region 9.

The further tumbler 19 is positioned by means of the tapered region 9. The further tumbler 19 is positioned radially outward.

In this embodiment, at least three different tumblers are positioned in total. Firstly, the tumblers cooperating with the control recess 10 are positioned. Furthermore, the tumbler 7 cooperating with the control element 6 is positioned and, in addition, the tumbler 19 cooperating with the tapered cross section 9 is positioned, such that the rotor 18 can be pivoted with respect to the fixed stator 17.

The further tumbler 19 comprises a stator sleeve 25 mounted movably in the stator 17 and a rotor sleeve 26 mounted movably in the rotor 18, and also a stator sleeve spring 27 acting on the stator sleeve 25. In the blocking position, rotor sleeve 26 and stator sleeve 25 run collinearly along a common axis B. The stator sleeve 25 is mounted movably in a stator bore 33 and the rotor sleeve 26 is mounted movably in a rotor bore 34. The stator sleeve spring 27 subjects the stator sleeve 25 and the rotor sleeve 26 to a spring force in the direction of the key channel 23. The rotor sleeve 26 projects with an end side 28 into the key channel 23. Via said end side 28, the rotor sleeve 26 and therefore also the stator sleeve 25 are movable radially outward from a blocking position into a release position by means of the outer side 5 or the surfaces 29 of the tapered region 9. The tapered region 9 cooperates with the end side 28.

In the present embodiment, the stator pin 20 and the rotor pin 21 are mounted movably in the stator sleeve 25 and the rotor sleeve 26, respectively. Stator pin 20 and rotor pin 21 are positionable here independently of the control of the stator sleeve 25 and of the rotor sleeve 26, respectively. Both stator pin 20 and rotor pin 21, and also stator sleeve 25 and rotor sleeve 26, therefore have to be moved from the blocking position into the release position such that the two tumblers 7, 19 are in the release position. If either the tumbler 7 with stator pin 20 and rotor pin 21 or the tumbler 19 with stator sleeve 25 and rotor sleeve 26 are not moved, i.e. positioned, into the release position by means of the key 1, rotation of the rotor 18 in the stator 17 is made impossible.

In an alternative embodiment which is not shown in the figures, the further tumbler 19 can also be designed analogously to the tumbler 7 with a rotor pin, a stator pin and a stator spring, wherein the further tumbler 19 then lies at a distance from the tumbler 7.

Figure 10:
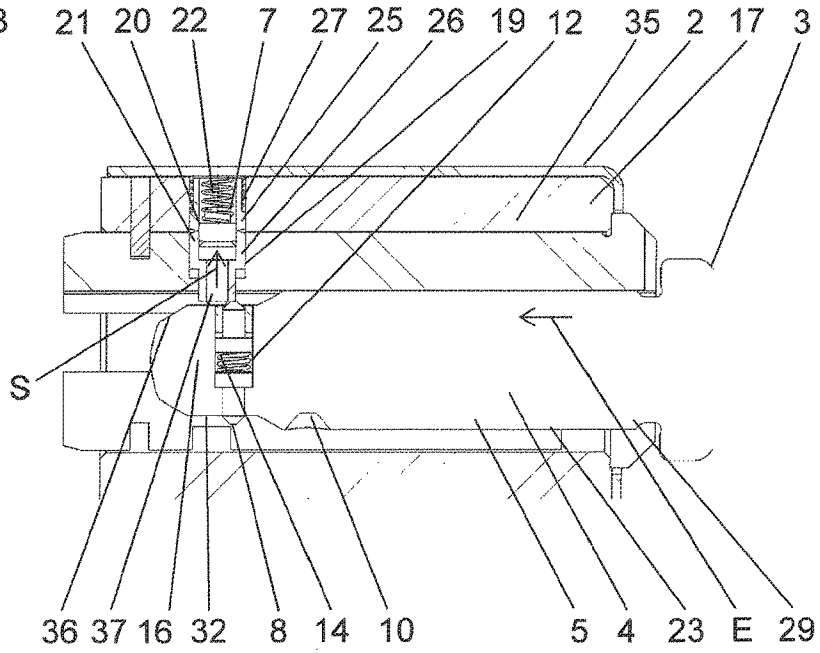
FIG. 10 shows the sectional illustration according to FIG. 7 with the key at a different position.
Figure 9:
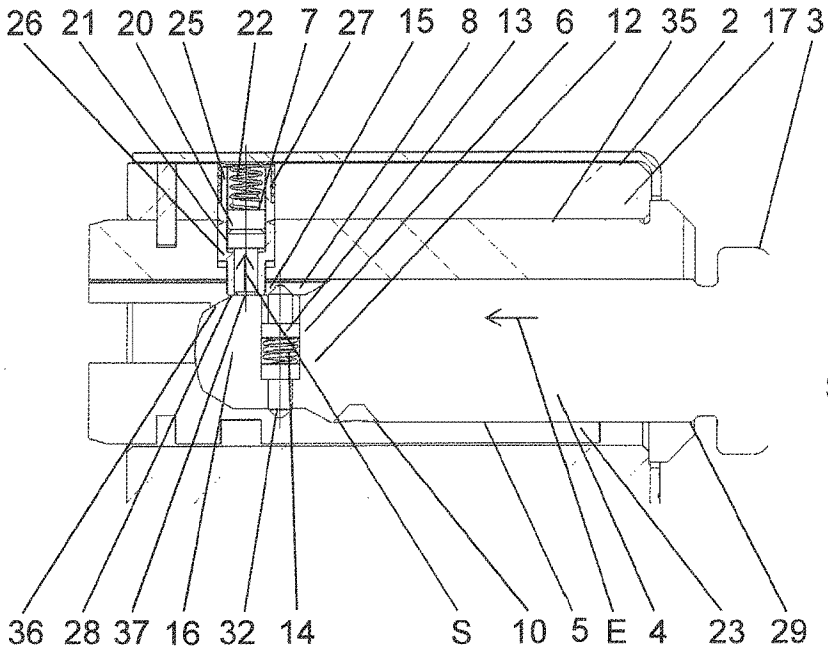
FIG. 9 shows the sectional illustration according to FIG. 7 with the key at a different position.

FIGS. 9 and 10 show the pushing of the key 1 into the key channel 23 of the rotary cylinder lock 2 according to the second embodiment. The tumblers 7 and 19 are still in the blocking position here.

If, in the embodiments according to FIGS. 7 to 12, an unauthorized key without the tapering is pushed in, the further tumbler 19 is not correctly positioned. The further tumbler 19 can firstly have the effect of a stop which stands in the way of the key. Secondly, in an embodiment which is not shown, the stator sleeve 25 can be designed to be shortened, such that rotor sleeve 26 and stator sleeve 25 are moved with the contact point thereof beyond the shear line 35. The rotor sleeve 26 then rests on the shear line 35 and thus blocks the relative movement between rotor sleeve 26 and stator sleeve 25. In other words, the rotor sleeve 26 is moved radially outward over the shear line 35.

The movability radially outward also has the advantage that the tapered region 9 can be arranged at a distance from the key tip 16. By this means, in a first step, the package of rotor sleeve 26 and stator sleeve 25 is moved by the key shank 4 of normal width with the rotor sleeve 26 over the shear line 35 and then, in a second step, when the tapered region acts on the rotor sleeve 26, is moved from the outside in the radial direction onto the shear line. In this embodiment, the positioning takes place radially from the outside. In other words, this means that the stator sleeve 25 or the rotor sleeve 26 is movable radially outward from a blocking position over the release position and subsequently radially inward into the release position.

Figure 12:
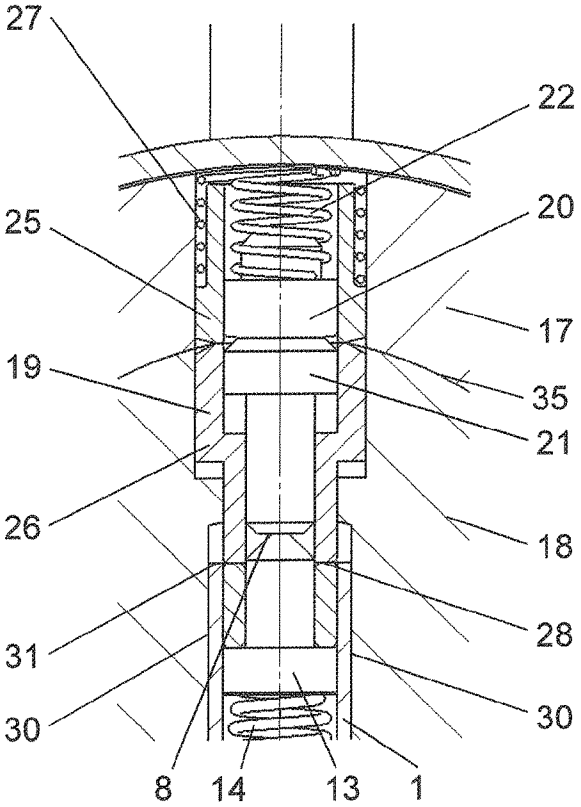
FIG. 12 shows a sectional illustration of FIG. 11 at a right angle to the longitudinal axis.
Figure 11:
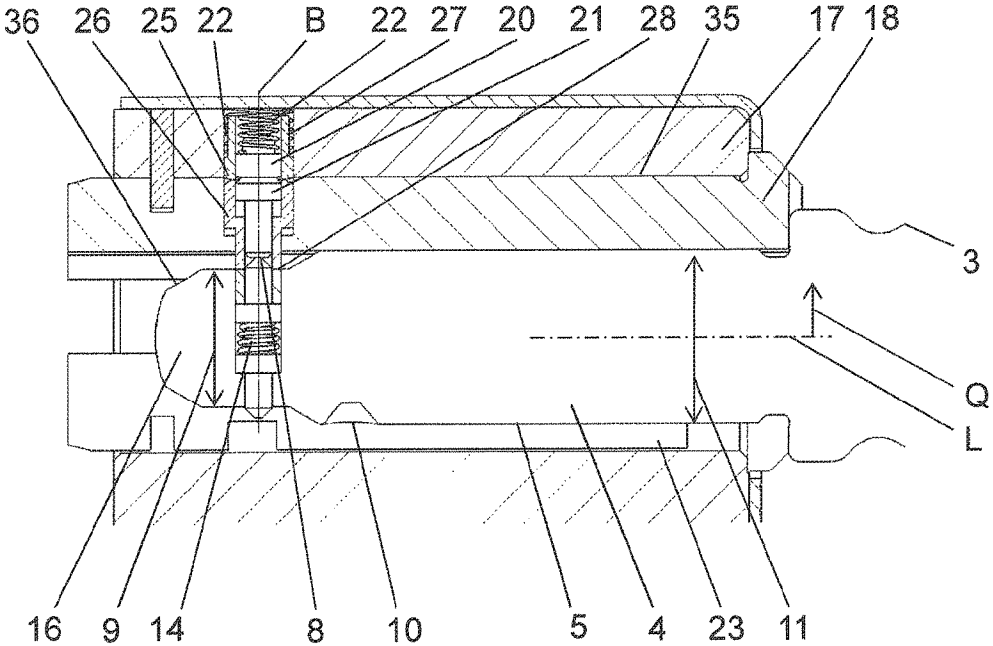
FIG. 11 shows the sectional illustration according to FIG. 7 with the key in the pushed-in position.

In FIGS. 11 and 12, the key 1 is in the completely pushed-in state, and the tumbler 7 and also the tumbler 19 are in the release position. It can readily be seen in these figures that the surface 31, 32 of the tapered region has moved the rotor sleeve 26 and the stator sleeve 25 to the height of the shear line 35. That is to say, the contact point between stator sleeve and rotor sleeve lies on the shear line between stator 17 and rotor 18. Furthermore, the tumbler 7 has been positioned in accordance with the above description. The spring element 14 of the control element 6 has likewise positioned the stator pin 20 and rotor pin 21 such that the contact point between rotor pin 21 and stator pin 20 is located on the shear line 35. The rotor 18 can therefore then be pivoted with respect to the fixed stator 17.

FIGS. 13 to 16 show a rotary cylinder lock 2 with a key 1 according to a third embodiment. In comparison to the first and the second embodiment, said third embodiment has an additional safety feature in the form of an elevation 44 formed on the key shank 4. The rotary cylinder lock 2 is formed here in accordance with the first or the second embodiment, and therefore reference is made to the above description. Furthermore, identical parts are provided with the same reference signs.

In this embodiment, the tapered cross section 9 of the key shank 4 is placed between key tip 16 and key grip 3 at a distance from the key tip 16. The key shank 4 has a first slope 42 along the longitudinal axis L, starting from the key tip 16 in the direction of the key grip 3. Said first slope 42 is essentially a surface which runs at an inclination to the longitudinal axis L and is designed in such a manner that it uniformly increases the key shank 4 on both sides with respect to the longitudinal axis L and rises here as far as an elevation 44. The elevation 44 has a surface 45 which is preferably formed parallel to the longitudinal axis L and which merges into a second slope 43. Said second slope 43, in turn in the form of a surface at an inclination to the longitudinal axis L, guides the elevation 44 back to a height of the first surface 31 and of the second surface 32 of the tapered cross section 9. In other words, the tapered cross section is limited in the longitudinal direction L toward the key tip 16 by the elevation 44.

In the region of the elevation 44, the height of the key shank 4 is variable. The elevation 44 preferably projects over the height of the first surface 31 and of the second surface 32, wherein the height here should be understood as meaning the distance along the transverse direction Q in relation to the longitudinal axis of the key shank 4. In this third embodiment too, the outer shape of the key 1 is preferably of symmetrical design with respect to the longitudinal axis L. However, it is also conceivable for the elevation 44 to be formed only on one side of the key shank 4 or for further elevations 44 or tapered regions 9 to be located on the key shank 4.

The rotary cylinder lock 2 and the cooperation with the above-described key 1 are now explained more precisely below. The rotary cylinder lock here corresponds to the second embodiment, but the rotary cylinder lock according to the first embodiment could likewise be used. However, it should be noted in the use of the rotary cylinder lock 2 according to the first and second embodiment that the further tumbler 19 has a modified stator bore 33, the length of which is greater than the length of the stator sleeve 25.

Figure 13:
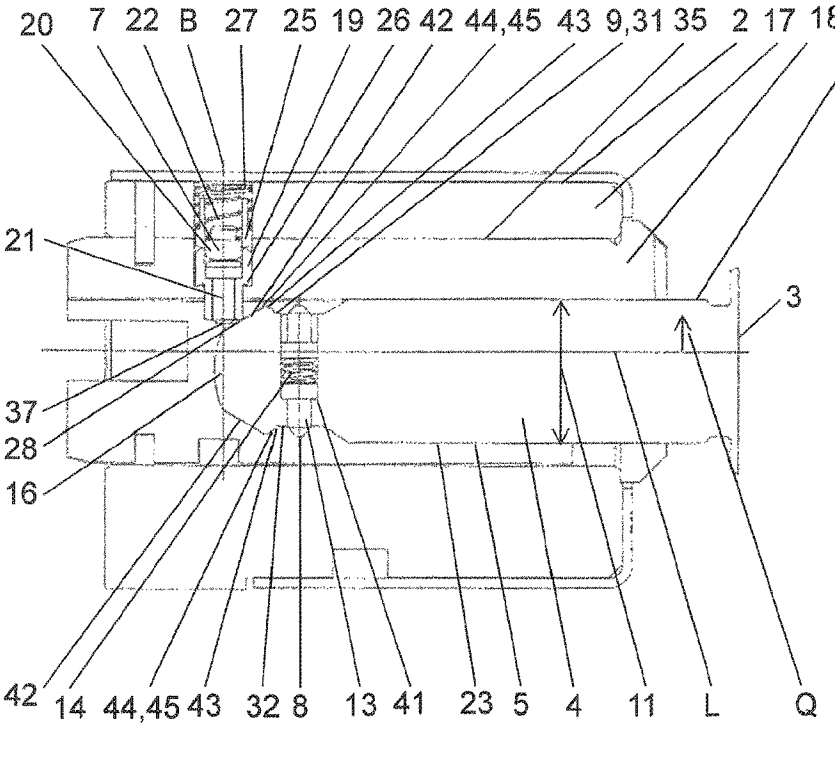
FIG. 13 shows a sectional illustration through a rotary cylinder lock according to a third embodiment with an associated key.

FIG. 13 shows a sectional view through the rotary cylinder lock 2 with a key 1 partially pushed into the key channel 23, wherein the elevation 44 and the tapered cross section are located in the region of the key tip 16. In this blocking position, the chamfer 36 of the key shank 4 comes into contact with the end side of the rotor sleeve 26, said end side projecting into the key channel 23.

Figure 14:
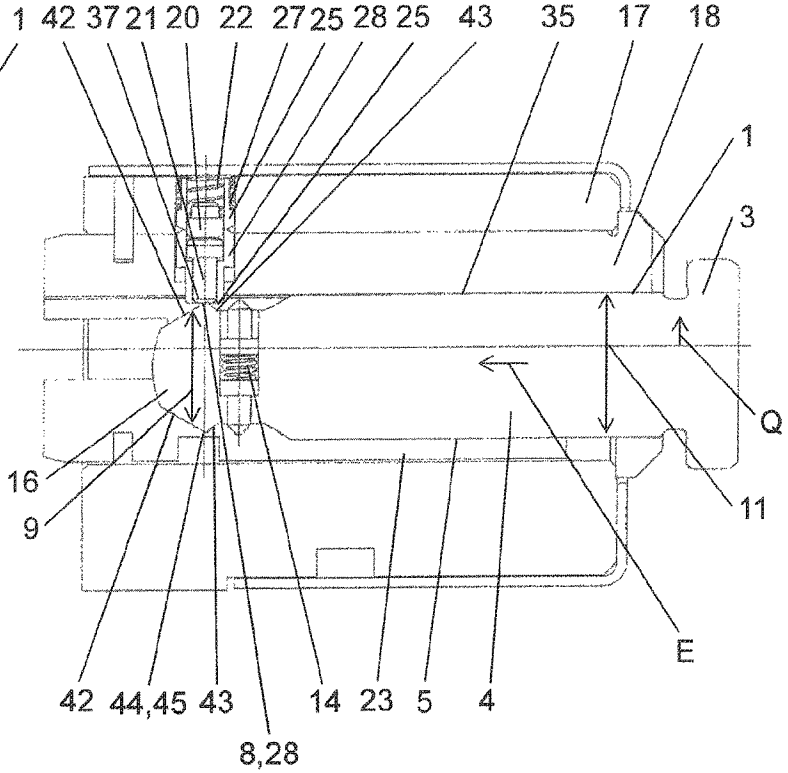
FIG. 14 shows the sectional illustration according to FIG. 13 with the key at a different position.

FIG. 14 shows the further pushing of the key 1 into the key channel 23 of the rotary cylinder lock 2 along the pushing-in direction E. The key 1 is pushed forward here to an extent such that the end side 28 comes to lie on the surface 45 of the elevation 44. Since the length of the stator bore 33 is greater than the length of the stator sleeve 25, at this position that side of the stator sleeve 25 which is opposite the end side 28 is flush with the outer side of the rotary cylinder lock 2. A stator sleeve, the length of which is not smaller than that of the stator bore, would therefore permit the key to be pushed in at maximum as far as this position.

Figure 16:
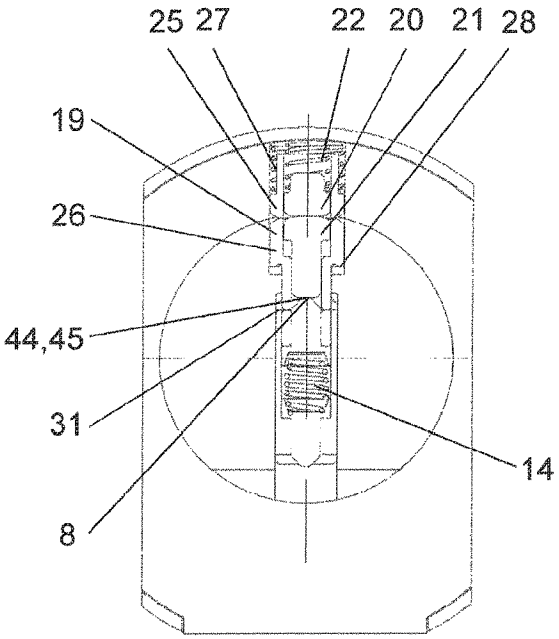
FIG. 16 shows a sectional illustration of FIG. 15 at a right angle to the longitudinal axis.
Figure 15:
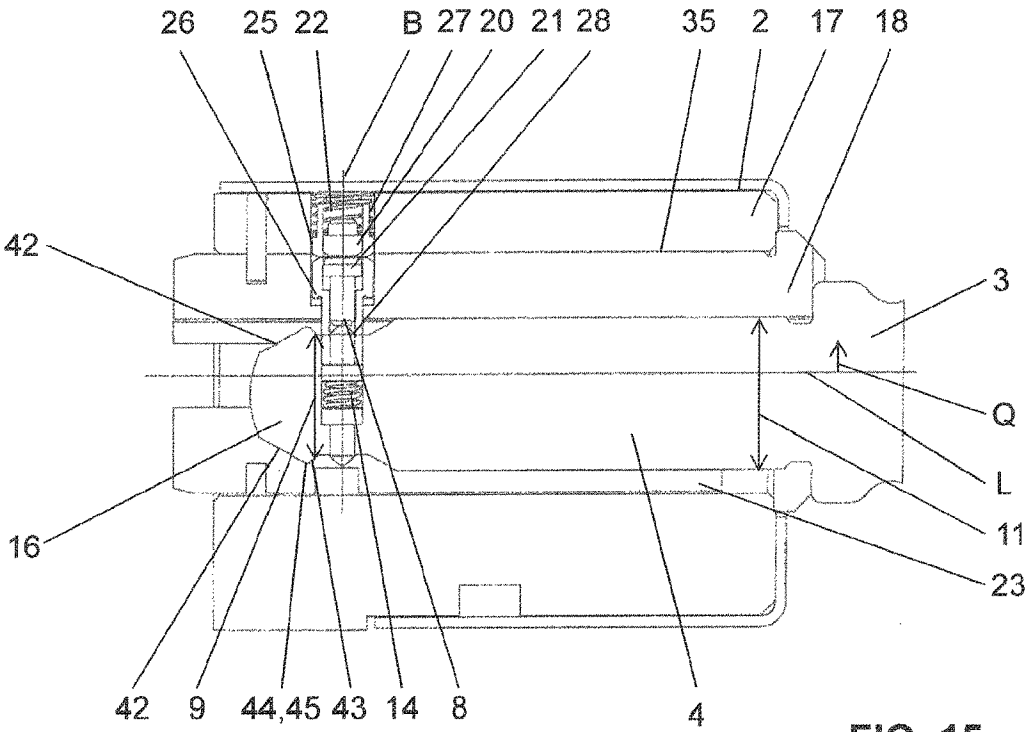
FIG. 15 shows the sectional illustration according to FIG. 13 with the key in the pushed-in position.

In FIGS. 15 and 16, the key 1 is in the fully pushed-in state, and the tumbler 7 and the further tumbler 19 are in the release position. Analogously to the figures of the first and second embodiments, it can also be readily seen in these figures that the surface 31, 32 of the tapered region has moved the rotor sleeve 26 and the stator sleeve 25 to the height of the shear line 35. That is to say, in the third embodiment too, the contact point between stator sleeve and rotor sleeve lies on the shear line between stator 17 and rotor 18. The tumbler 7 has likewise been positioned in accordance with the above description. The spring element 14 of the control element 6 has likewise positioned the stator pin 20 and rotor pin 21, such that the contact point between rotor pin 21 and stator pin 20 is located on the shear line 35. The rotor 18 can therefore now be pivoted with respect to the fixed stator 17. The tumbler 19 serves as an active and high-quality guard against manipulation in the cylinder.

LIST OF REFERENCE SIGNS

1 Key
2 Rotary cylinder lock
3 Key grip
4 Key shank
5 Outer side
6 Control element
7 Tumbler
8 Control surface
9 Tapered cross section
10 Control recess
11 Cross section
12 Bore
13 Bolt
14 Spring element
15 Control edge
16 Key tip
17 Stator
18 Rotor
19 Tumbler
20 Stator pin
21 Rotor pin
22 Stator spring
23 Key channel
24 Guide sleeve
25 Stator sleeve
26 Rotor sleeve
27 Stator sleeve spring
28 End side
29 Narrow surface
30 Wide surface
31 First surface of the tapered region
32 Second surface of the tapered region
33 Stator bore
34 Rotor bore
35 Shear line
36 Chamfer
37 End side
38 Inclined surface
39 Flange
40 Step
41 Sleeve
42 First slope
43 Second slope
44 Elevation
45 Surface
46 Stator outer sleeve
L Longitudinal axis
Q Transverse direction
A Axis
B Axis
E Pushing-in direction
S Radial movement

The invention claimed is:

1. A key for a rotary cylinder lock, comprising a key grip and a key shank which adjoins the key grip and extends along a longitudinal axis, wherein the key shank comprises, on the outer side thereof, control recesses, in particular control bores, for positioning tumblers on the rotary cylinder lock, and at least one control element arranged movably in the key shank, which control element has a control surface cooperating with a tumbler of the rotary cylinder lock, wherein the key shank, in the region of the control element, has a tapered cross section which is tapered in relation to the cross section with the control recesses, wherein the tapered cross section or a further tapered cross section is arranged between the key tip and the key grip at a distance from the key tip, wherein the key shank has an elevation between the key tip and the tapered cross section wherein the key shank has a first slope and a second slope, wherein the first slope rises to the elevation, and wherein the second slope runs toward the tapered cross section.

2. The key as claimed in claim 1, wherein the control element protrudes out of the key shank such that the control surface lies at a distance from the outer side of the tapered cross section.

3. The key as claimed in claim 1, wherein the control surface lies flush with the outer side of the tapered cross section.

4. The key as claimed in claim 3, wherein, in the starting position, the control surface lies in a plane which is defined by the outer side of the key shank in the region of the control recesses, or wherein the control surface lies in a region between the outer side of the tapered cross section and said plane.

5. The key as claimed claim 1, wherein the control element comprises a bolt arranged in a bore in the key, and a spring element, in particular a compression spring, which spring element subjects the bolt to a force which presses the control element outward, as seen from the key shank, wherein the bolt has said control surface.

6. The key as claimed in claim 1, wherein the control element has two bolts which extend along a common axis and are acted upon by the same spring element, wherein the first bolt protrudes over a first surface on the key shank or is flush with said surface, and the second bolt protrudes over a second surface on the key shank or is flush with said surface, which surfaces lie opposite each other with respect to the longitudinal axis and in particular provide the narrow side of the key.

7. The key as claimed in claim 4, wherein the bolt has a cylindrical, in particular circular, cross section, and/or wherein the bolt is provided with a control edge in the region of the control surface, which control edge runs at an angle to the longitudinal axis.

8. The key as claimed in claim 1, wherein the tapered cross section forms the end region of the key shank in the region of the key tip opposite the key grip.

9. The key as claimed in claim 1, wherein the elevation extends transversely with respect to the longitudinal direction of the key shank at maximum to the maximum extension of the key shank.

10. A rotary cylinder lock and key as claimed in claim 1, wherein the rotary cylinder lock comprises a stator, a rotor mounted rotatably in the stator, with a key channel, and at least one tumbler cooperating with the control element, wherein the tumbler comprises a stator pin mounted in the stator and a rotor pin mounted in the rotor, wherein rotor pin and stator pin are positionable from a blocking position to a release position by the control element, and wherein, in the blocking position, the rotor pin preferably projects into the key channel.

11. The rotary cylinder lock as claimed in claim 10, wherein the rotor pin and stator pin are movable radially outward from the blocking position into the release position.

12. The rotary cylinder lock as claimed in claim 10, wherein the stator pin in the stator is subjected to a spring force by a stator spring, wherein the spring force presses the stator pin and the rotor pin in the direction of the key channel.

13. The rotary cylinder lock as claimed claim 12, wherein the spring force of the spring element in the key is greater than the spring force of the stator spring, such that the control element moves the stator pin and the rotor pin radially outward with respect to the key channel when the control element comes into contact with the rotor pin.

14. The rotary cylinder lock as claimed in claim 10, wherein the rotor pin is mounted movably in a guide sleeve which projects into the key channel, which guide sleeve is fixedly connected to the rotor and cooperates with the tapered cross section.

15. The rotary cylinder lock as claimed in claim 14, wherein, during the introduction movement of the key into the rotary cylinder lock, the control element cooperates with the guide sleeve, in particular via a control edge, and is thereby movable to the height of the tapering.

16. The rotary cylinder lock as claimed in claim 10, wherein, in addition to the tumbler which cooperates with the control element, a further tumbler is provided, which cooperates with the outer side of the tapered cross section and is movable radially outward from a blocking position into a release position.

17. The rotary cylinder lock as claimed in claim 16, wherein the further tumbler comprises a stator sleeve mounted movably in the stator and a rotor sleeve mounted movably in the rotor, and a stator sleeve spring acting on the stator sleeve, wherein the stator sleeve spring subjects the stator sleeve and the rotor sleeve to a spring force in the direction of the key channel, and wherein rotor sleeve projects with an end side into the key channel and is movable via said end side from the blocking position into the release position by the outer side of the tapered cross section.

18. The rotary cylinder lock as claimed in claim 16, wherein the stator sleeve and the rotor sleeve, respectively, are mounted movably, wherein the stator sleeve and the rotor sleeve, respectively, are movable radially outward from a blocking position into a release position, or wherein the stator sleeve and the rotor sleeve, respectively, are movable radially outward from a blocking position over the release position and subsequently radially inward into the release position.

19. The rotary cylinder lock as claimed in claim 16, wherein the stator pin and the rotor pin are mounted movably in the stator sleeve and the rotor sleeve, respectively, and are movable radially outward from a blocking position into a release position.

20. The rotary cylinder lock as claimed in claim 10, wherein, when the key is pushed into the key channel, the tumbler, in particular the stator pin and rotor pin, respectively, and/or the further tumbler, in particular the stator sleeve and rotor sleeve, respectively, are movable radially outward via the elevation from a blocking position over the release position and are then movable from over the release position into the release position.

21. The rotary cylinder lock as claimed in claim 20, wherein the tumbler or the further tumbler has a stator bore in which the stator pin and/or the stator sleeve is mounted movably, wherein the length of the stator bore is greater than the length of the stator pin and of the stator sleeve, respectively.

22. A rotary cylinder lock and key said key comprising a key grip, and a key shank which adjoins the key grip and extends along a longitudinal axis, wherein the key shank comprises, on the outer side thereof, control recesses, in particular control bores, for positioning tumblers on the rotary cylinder lock, and at least one control element arranged movably in the key shank, which control element has a control surface cooperating with a tumbler of the rotary cylinder lock, wherein the key shank, in the region of the control element, has a tapered cross section which is tapered in relation to the cross section with the control recesses, wherein the rotary cylinder lock comprising a stator, a rotor mounted rotatably in the stator, with a key channel, and at least one tumbler cooperating with the control element, wherein the tumbler comprises a stator pin mounted in the stator and a rotor pin mounted in the rotor, wherein rotor pin and stator pin are positionable from a blocking position to a release position by the control element, and wherein, in the blocking position, the rotor pin preferably projects into the key channel, wherein in addition to the tumbler which cooperates with the control element, a further tumbler is provided, which cooperates with the outer side of the tapered cross section and is movable radially outward from a blocking position into a release position and wherein the further tumbler comprises a stator sleeve mounted movably in the stator and a rotor sleeve mounted movably in the rotor, and a stator sleeve spring acting on the stator sleeve, wherein the stator sleeve spring subjects the stator sleeve and the rotor sleeve to a spring force in the direction of the key channel, wherein rotor sleeve projects with an end side into the key channel and is movable via said end side from the blocking position into the release position by the outer side of the tapered cross section;

wherein the tapered cross section or a further tapered cross section is arranged between the key tip and the key grip at a distance from the key tip, wherein the key shank has an elevation between the key tip and the tapered cross section; and wherein the key shank has a first slope and a second slope, wherein the first slope rises to the elevation, and wherein the second slope runs toward the tapered cross section.

23. The rotary cylinder lock and key as claimed in claim 22, wherein the control element protrudes out of the key shank such that the control surface lies at a distance from the outer side of the tapered cross section.

24. The rotary cylinder lock and key as claimed in claim 22, wherein the control surface lies flush with the outer side of the tapered cross section.

25. The rotary cylinder lock and key as claimed in claim 22, wherein, in the starting position, the control surface lies in a plane which is defined by the outer side of the key shank in the region of the control recesses, or wherein the control surface lies in a region between the outer side of the tapered cross section and said plane.

26. The rotary cylinder lock and key as claimed in claim 22, wherein the control element comprises a bolt arranged in a bore in the key, and a spring element, in particular a compression spring, which spring element subjects the bolt to a force which presses the control element outward, as seen from the key shank, wherein the bolt has said control surface.

27. The rotary cylinder lock and key as claimed in claim 26, wherein the bolt has a cylindrical, in particular circular, cross section, and/or wherein the bolt is provided with a control edge in the region of the control surface, which control edge runs at an angle to the longitudinal axis.

28. The rotary cylinder lock and key as claimed in claim 22, wherein the control element has two bolts which extend along a common axis and are acted upon by the same spring element, wherein the first bolt protrudes over a first surface on the key shank or is flush with said surface, and the second bolt protrudes over a second surface on the key shank or is flush with said surface, which surfaces lie opposite each other with respect to the longitudinal axis and in particular provide the narrow side of the key.

29. The rotary cylinder lock and key as claimed in claim 28, wherein the bolt has a cylindrical, in particular circular, cross section, and/or wherein the bolt is provided with a control edge in the region of the control surface, which control edge runs at an angle to the longitudinal axis.

30. The rotary cylinder lock and key as claimed in claim 22, wherein the tapered cross section forms the end region of the key shank in the region of the key tip opposite the key grip.

31. The rotary cylinder lock and key as claimed in claim 22, wherein the elevation extends transversely with respect to the longitudinal direction of the key shank at maximum to the maximum extension of the key shank.

32. The rotary cylinder lock and the key as claimed in claim 22, wherein rotor pin and stator pin are movable radially outward from the blocking position into the release position.

33. The rotary cylinder lock and the key as claimed claim 22, wherein the stator pin in the stator is subjected to a spring force by a stator spring, wherein the spring force presses the stator pin and the rotor pin in the direction of the key channel.

34. The rotary cylinder lock and the key as claimed in claim 22, wherein the spring force of the spring element in the key is greater than the spring force of the stator spring, such that the control element moves the stator pin and the rotor pin radially outward with respect to the key channel when the control element comes into contact with the rotor pin.

35. The rotary cylinder lock and the key as claimed in claim 22, wherein the stator sleeve and the rotor sleeve, respectively, are mounted movably, wherein the stator sleeve and the rotor sleeve, respectively, are movable radially outward from a blocking position into a release position, or wherein the stator sleeve and the rotor sleeve, respectively, are movable radially outward from a blocking position over the release position and subsequently radially inward into the release position.

36. The rotary cylinder lock and the key as claimed in claim 22, wherein the stator pin and the rotor pin are mounted movably in the stator sleeve and the rotor sleeve, respectively, and are movable radially outward from a blocking position into a release position.

37. The rotary cylinder lock and the key as claimed in claim 22, wherein, when the key is pushed into the key channel, the tumbler, in particular the stator pin and rotor pin, respectively, and/or the further tumbler, in particular the stator sleeve and rotor sleeve, respectively, are movable radially outward via the elevation from a blocking position over the release position and are then movable from over the release position into the release position.

38. The rotary cylinder lock as claimed in claim 37, wherein the tumbler or the further tumbler has a stator bore in which the stator pin and/or the stator sleeve is mounted movably, wherein the length of the stator bore is greater than the length of the stator pin and of the stator sleeve, respectively.

* * * * *